United States Patent [19]

Pierson

[11] Patent Number: 4,828,929

[45] Date of Patent: May 9, 1989

[54] OCTAGONAL BOX WITH INTEGRAL LINER

[75] Inventor: Paul R. Pierson, Rochester, N.Y.

[73] Assignee: Weyerhaeuser Company, Tacoma, Wash.

[21] Appl. No.: 39,621

[22] Filed: Apr. 16, 1987

[51] Int. Cl.[4] ..... B65D 5/22

[52] U.S. Cl. ..... 428/542.8; 229/41 B; 229/41 C; 229/109

[58] Field of Search ..... 229/41 C, 109, 41 B; 428/542.8

[56] References Cited

U.S. PATENT DOCUMENTS

| | | | |
|---|---|---|---|
| 2,147,563 | 2/1939 | Turner | 229/109 |
| 2,499,780 | 3/1950 | Rottman | 229/41 C |
| 2,751,138 | 6/1956 | Laver | 229/109 |
| 4,134,531 | 1/1979 | Martinez et al. | 229/41 C |
| 4,296,860 | 10/1981 | Hsu et al. | 229/23 R |
| 4,742,915 | 5/1988 | Ringer | 229/41 B |

FOREIGN PATENT DOCUMENTS

| | | | |
|---|---|---|---|
| 158551 | 8/1954 | Australia | 428/542.8 |
| 1320926 | 2/1963 | France | 229/41 C |
| 2116150 | 9/1983 | United Kingdom | 428/542.8 |

*Primary Examiner*—Henry F. Epstein
*Attorney, Agent, or Firm*—Notaro & Michalos

[57] ABSTRACT

An octagonal box having an integral liner is formed from a blank having an octagonal central panel with a pair of a series of transversely-scored side wall panels centrally hinged along two opposite longitudinal side edges of the blank and a pair of a series of longitudinally scored liner panels, each being centrally foldable along side wall panels attached to opposite transverse side edges of the blank.

5 Claims, 3 Drawing Sheets

OCTAGONAL BOX WITH INTEGRAL LINER

BACKGROUND OF THE INVENTION

The invention relates to a corrugated box with an integral reinforcing liner and, more particularly, to a one-piece corrugated fibreboard blank for forming an octagonal box that includes an integral liner to provide at least a double thickness of reinforcement in the assembled box.

Corrugated fibreboard boxes having an octagonal shape are useful in the packaging and shipping of a variety of products such as cheese in the cylindrical form of a so-called cheese wheel. In such cases, the packaged cheese product can be relatively heavy, for example, a cheese wheel having a diameter of about 10-inches (approx. 4 cm), packaged in a relatively shallow box, might weigh on the order of 9 pounds (approx. 4 kg). Thus, a blank of a heavy-duty grade of corrugated board may have to be utilized for forming the box and, in some cases, a separate liner will have to be added to the box to strengthen the sides and provide additional stacking strength.

SUMMARY OF THE INVENTON

An octagonal box, in accordance with the invention, is formed from a blank which has an integral liner. The blank is composed of an octagonal central panel with a pair of a series of transversely-scored side panels hinged to a first pair of opposite side edges and a pair of a series of liner panels connected to opposite side wall panels hinged to a second pair of opposite side edges of the blank. Each of the side panels connected to the series of liners includes folding means for inverting the attached series of liner panels by 180-degrees. In a preferred embodiment, the folding means comprises two parallel lines of closely-spaced perforations extending through the blank.

In a preferred embodiment, a box formed from the blank comprises the bottom portion of a container which includes a unique integral liner which greatly increases top to bottom compression strength. The integral liner advantageously provides added supporting strength so that a lighter grade of corrugated board can be used. The use of an integral liner also advantageously avoids the need for fabrication, handling and assembly of a separate liner piece.

The inventive box may also be advantageously utilized as a telescoping top cover for use with a bottom having an identical or conventional design.

BRIEF DESCRIPTION OF THE DRAWINGS

In the accompanying drawings, forming a part of this specification, and in which reference numerals shown in the drawings designate like or corresponding parts throughout the same.

DETAILED DESCRIPTION

Figure 1:
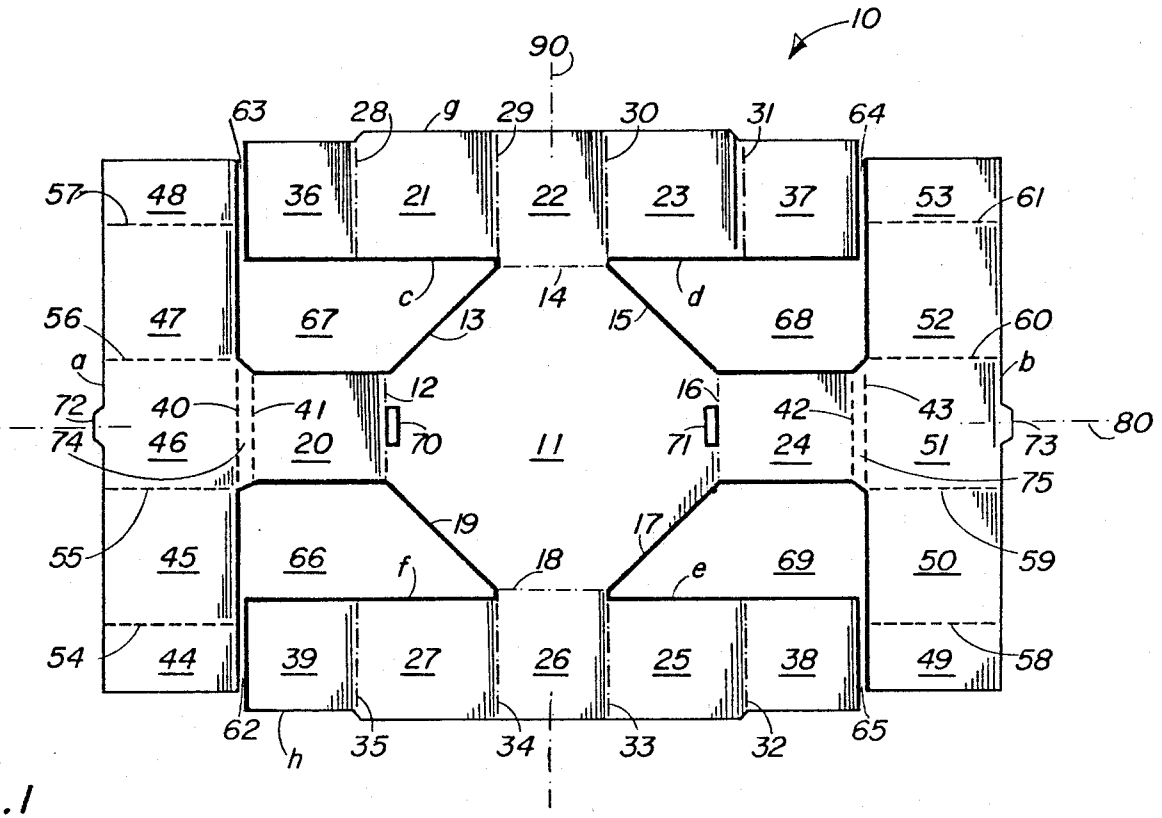
FIG. 1 is a top plan view of a blank for forming an octagonal box embodying the invention.

FIG. 1 illustrates a one-piece, single-wall corrugated fibreboard blank 10 for forming an octagonal box. As shown, blank 10 is a substantially planar rectangular blank which, as described in detail hereafter, has a plurality of series of side wall forming panels and liner forming panels disposed about a central octagonal panel symetrically of the longitudinal and transverse centerlines 80, 90 of the blank 10.

Blank 10 includes an octagonal shaped central throughout panel 11 that has a periphery defined by eight successive edges including four side edges 12, 14, 16, 18 and four intervening corner edges 13, 15, 17, 19. A first side panel 20, a second side panel 22, a third side panel 24 and a fourth side panel 26 are hinged to the bottom panel 11 along score lines at the side edges 12, 14, 16 and 18, respectively.

A first corner panel 21 and a second corner panel 23 are hinged to opposite transverse edges of the second side panel 22 along transverse score lines 29, 30. A third corner panel 25 and a fourth corner panel 27 are hinged to opposite transverse edges of the fourth side panel 26 along transverse score lines 33, 34.

A first inner side panel 36 and a second inner side panel 37, are hinged, along transverse score lines 28, 31 to the transverse edges of the first and second corner panels 21, 23, respectively. A third inner side panel 38 and a fourth inner side panel 39 are hinged, along transverse score lines 32, 35 to the transverse edges of the corner panels 25, 27 respectively. The transverse score lines 28, 31, 32, 35 are parallel to the inner score lines 29, 30, 33, 34. Thus, in sequence, first inner side panel 36, first corner panel 21, second side panel 22, second corner panel 23 and second inner side panel 37 are serially connected by the score lines 28, 29, 30 and 31 to form a first series of wall panels spaced from one side of the longitudinal center line 80 passing through blank 10. Similarly, in sequence, fourth inner side panel 39, fourth corner panel 27, fourth side panel 26, third corner panel 25 and third inner side panel 38 are serially interconnected by score lines 35, 34, 33 and 32 to form a second series of wall panels spaced from a side of the longitudinal center line 80 of blank 10, opposite to the first series of wall panels. As shown in FIG. 1, the first and second series of wall panels are symetrical relative to the longitudinal center line 80 and panels of identical configuration comprising each series are disposed transversely opposite the longitudinal center line 80 in mirror-image of each other.

The first side panel 20 has two transversely extending parallel lines, each composed of series of closely-spaced perforations 40, 41 adjacent to the edge of first side panel 20 that is opposite side edge 12. Similarly, the third side panel 24 is provided with two transversely extending parallel lines, each composed of a series of closely-spaced perforations 42, 43, adjacent to the edge of panel 24 opposite side edge 16.

A first side liner panel 46 is hinged to first side panel 20 along the transversely extending line of perforations 40. On the opposite side of the blank 10, a third side liner panel 51 is hinged to the third side panel 24 along the transversely extending line of perforations 43.

Series of closely-spaced perforations 55, 56, extending in the longitudinal direction of the blank 10, separate side edges of the first side liner panel 46 from a first corner liner panel 47 and a forth corner liner panel 45 which, in turn, are separated by longitudinally extending series of closely spaced perforations 57, 54 from a first partial side liner panel 48 and a fourth partial side liner panel 44. The first and fourth corner liner panels 47, 45 the first and fourth partial liner panel 48, 44, are connected to the remaining portion of the blank via the first side liner panel 46, and are foldable relative to the remainder of the blank 10 along the line of perforations 40, but are otherwise separated from the remaining portions of the blank 10 by spaces 62, 63, 66 and 67.

Similarly, at the opposite end of the blank 10, a series of closely-spaced perforations 59, 60, extending in the longitudinal direction of the blank 10, separate side edges of the third side liner panel 51 from a second corner liner panel 52 and a third corner liner panel 50 which, in turn, are separated by longitudinally extending series of closely-spaced perforations 58, 61 from a second partial side liner panel 49. The second and third corner liner panels 52, 50 as well as the second and third partial side liner panels 53, 49, are connected to the remaining portion of the blank 10 via third side liner panel 51, and are foldable relative the remainder of the blank 10 along the line of perforations 43, but are otherwise separated from the remaining portions of the blank by spaces 64, 65, 68, 69.

The bottom panel 11 includes two slots 70, 71, extending therethrough, which are formed adjacent to, and centrally of, the side edges 12, 16, respectively.

The first and third side liner panels 46, 51 include tabs 72, 73 formed centrally along and projecting from the free transverse outer edges a, b of the blank 10 centrally of first side liner panel 46 and third side liner panel 51, respectively. Tabs 72, 73 are designed to be inserted into the slots 70, 71, respectively, as more particularly described hereafter.

Figure 4:
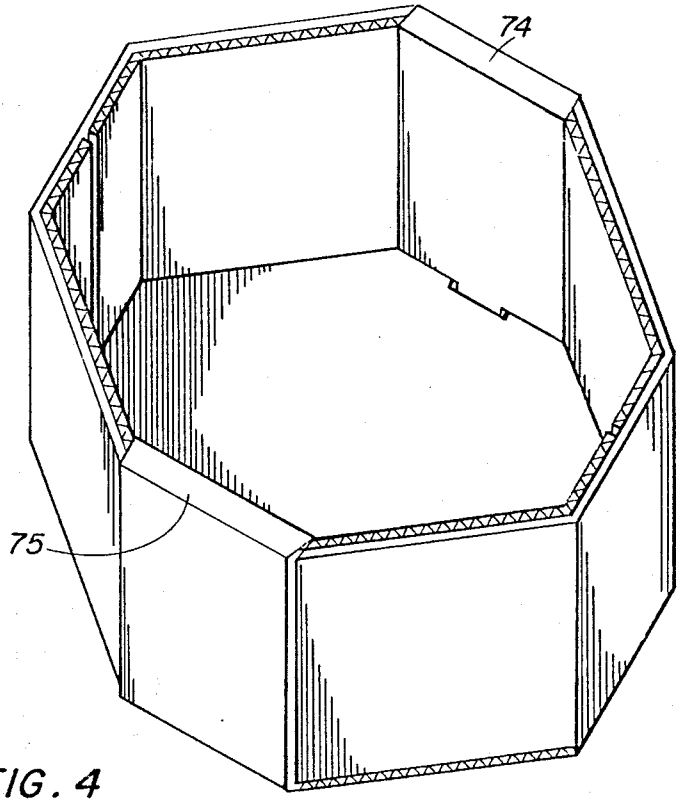
FIG. 4 is a top perspective view of the octagonal box of FIG. 2.

The surface of the blank 10, as shown in FIG. 1, will form the inside of the box when the blank is assembled into the octagonal box of the invention as shown, for example, in FIG. 4.

For forming the octagonal box, the second and fourth side panels 22, 26 are bent upwardly and inwardly, relative to bottom panel 11, along the score lines defining side edges 14, 18 until the panels 22, 26 are oriented substantially perpendicular to the bottom panel 11. The corner panels 21, 23, 25, 27 are then bent inwardly along transverse score line 29, 30, 33, 34 until the inner edges c, d, e, f thereof overlie the corner edges 13, 15, 17, 19 so that the corner panels 21, 23, 25, 27 are then oriented substantially perpendicular to the bottom panel 11 and there being an angle of approximately 135-degrees intermediate each corner panel and the adjacent wall panel.

Figure 3:
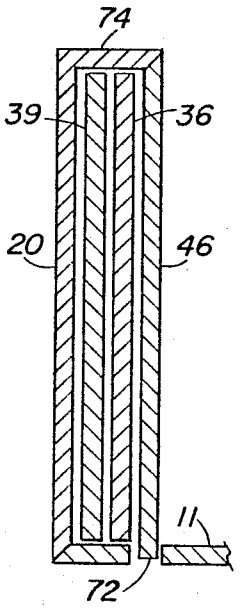
FIG. 3 is a partial sectional view taken along view line 3—3 of FIG. 2.

The first, second, third and fourth inner side panels 36, 37, 38, 39 are then bent inwardly along transverse score lines 28, 31, 32, 35, respectively, until their inner edges c, f of inner side panels 36, 39 overlie the bottom panel 11 adjacent to side edge 12. The inner face of one of the adjacent pairs of inner side panels 39, 36, or 37, 38, as a result, overlaps the outer face of the other, as is shown in FIG. 3 in respect of inner side panels 39, 36, thereby forming a double thickness of liner which is perpendicular to the central panel 11 adjacent and parallel to the first side panel 20 and third side edges 16 (not shown in FIG. 3).

The first side panel 20 is then bent upwardly and inwardly relative to the bottom panel 11 so that the inner face of the first side panel 20 abuts against the outer face of the outermost face of the pairs of first and fourth inner side panels 36, 39. Similarly, third side panel 24 is bent upwardly and inwardly so that the inner face abuts the outer face of the outermost of second and third inner side panel 37, 38 (not shown).

The first and third liner panels 46, 51 are then bent along the lines of perforations 41, 42 so that the portions 74, 75, intermediate the lines of perforations 40, 41 and perforations 42, 43, horizontally overlie the portions of longitudinal outer edges g, h of the blank 10 adjacent to side panels 36, 37, 38, 39.

The panels 46, 51 are then bent, along the lines of perforations 40, 43, downwardly toward the bottom panel 11, thereby inverting the panels 44, 45, 47, 48 attached to panel 46 and the panels 49, 50, 52, 53 attached to panel 51 and each of which, in turn, is then folded along the lines of perforations 54–61 until the tabs 72, 73 are received into the slots 70, 71, respectively. The tabs 72, 73 are held in place by engagement with portions of the blank defining the periphery of the slots 70, 71. The tabs 72, 73 thereby render the panels self-locking without the need to employ extraneous tapes or adhesives to maintain the shape of the box. The self-locking feature also allows the box to be easily disassembled.

To facilitate fitting the inner side panels between the side panels and side liner panels, the fluting thereof can be crushed between the linerboard comprising the inner side panels.

Figure 2:
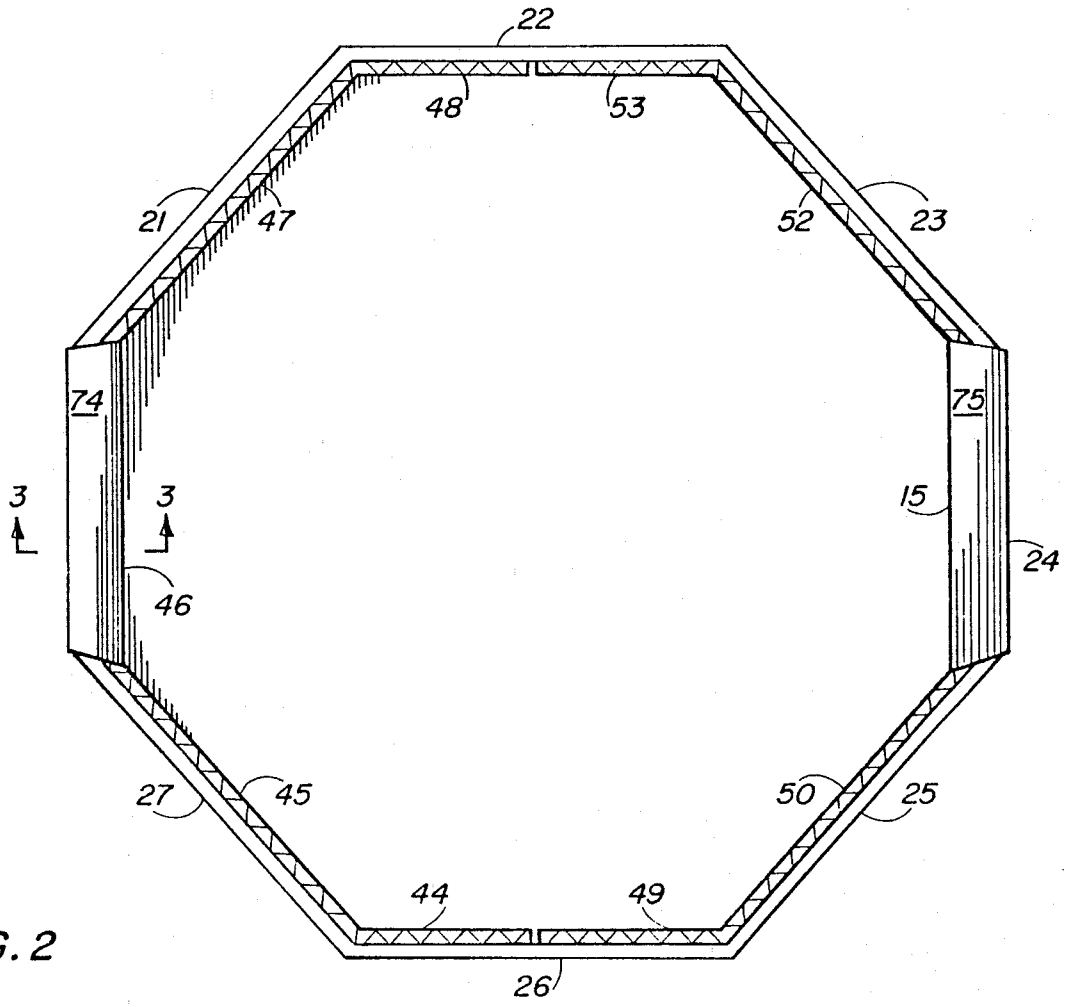
FIG. 2 is a top plan view of the open end of an octagonal box, according to the invention, formed from the blank of FIG. 1.

A top plan view of the assembled container 10 is illustrated in FIG. 2. The use of perforations, in the longitudinal direction, simplifies the fabrication of the blank 10. Alternatively, reverse score lines can be formed, on the side of the blank 10 opposite the side shown in FIG. 1 in lieu of the longitudinal lines of perforations.

A second blank 10, appropriately dimensioned, can be utilized to form an octogonal telescoping closure, for the box of FIG. 4, to further strengthen and enhance the properties of the box, particularly stacking strength. Alternatively, a conventional cover can be used. The blank 10, moreover, need not be limited in use solely to formation of the bottom portion of the box. It could, for example, be used to form a top telescoping closure which will be used with a conventional bottom member.

The corrugations of fluting of the corrugated fibreboard blank 10 will preferably extend in the longitudinal direction.

Octagonal boxes with integral liners, in accordance with the invention, have particular utility for the packaging of cheese wheel of sizes previously described and, as well as other products of similar size and cylindrical shape, but may also be used for different products requiring the unique design and superior strength of such boxes.

The invention claimed is:

1. A planar blank for forming an octagonal box comprising:

a central panel (11) having an octagonal periphery including four side edges (12, 14, 16, 18) and four corner edges (13, 15, 17, 19), each of the corner edges being interconnected between two of the side edges, the central panel having a transverse center line (90) and a longitudinaol center line (80);

first and third side panels (20, 24) each having a first end hinged to a respective one of opposite side edges (12, 16) of the central panel;

a first side liner panel (46) connected to a second end of said first side panel (20);

a third side liner panel (51) connected to a second end of said third side panel (24);

first and fourth corner liner panels (47, 45) hinged to opposite side edges (56, 55) of said first side liner panel (46);

first and fourth partial side liner panels (48, 44) hinged to respective outer edges (57, 54) of said first and fourth corner liner panels;

second and third conrer liner panels (52, 50) hinged to opposite side edges (60, 59) of said third side liner panel (51);

second and third partial side liner panels (53, 49) hinged to respective outer edges (61, 58) of said second and third corner liner panels;

said first partial liner panel, said first corner liner panel, said first side liner panel, said fourth corner liner panel and said fourth partial liner panel forming a first series of liner panels; said second partial liner panel, said second corner liner panel, said third side liner panel, said third corner liner panel and said third partial liner panel forming a second series of liner panels; said first and second series of liner panels being symmetrical to the transverse center line (90), said first and second series of liner panels lining the interior side and corner panels of the box to be made from the blank;

folding means (40, 74, 41; 42, 75, 43) connected between said first side panel and said first side liner panel, and between said third side panel and said third side liner panel, for inverting the respective series of liner panels attached thereto by 180-degrees relative to the respective first and third side panels attached thereto; and opposed identical series of side panels (36, 21, 22, 23, 37; 39, 27, 26, 25, 38), including a second and fourth side panel (22, 26) hinged to a respective one of the side edges (14, 18) parallel to and symmetrical of the longitudinal center line (80) of the blank.

2. A planar blank, as set forth in claim 1, wherein the folding means comprises a pair of parallel lines of closely-spaced perforations extending through the blank.

3. A planar blank, as set forth in claim 1, further comprising a pair of slots extended through the blank adjacent one pair of side edges parallel to the transverse center line, and two tabs, one of the tabs being connected to the first side liner panel and the other being connected to the second side liner panel.

4. A planar blank, as set forth in claim 3, wherein the blank comprises single wall corrugated fibreboard.

5. An octagonal box comprising:

a central panel having an octagonal periphery including four side edges and four corner edges, each of the corner edges being interconnected between two of the side edges;

first and third side panels each having a first end hinged to a respective one of opposed side edges of the central panel by score lines, each of the first and third side panels having a second end opposite the first end;

opposed second and fourth side panels hingedly connected to opposite side edges of the central panel by score lines;

first, second, third and fourth conrer panels, each overlapping part of the central panel adjacent one of the corner edges, the first and second corner panels being hingedly connected to the second side panel and the third and fourth corner panels being hingedly connected to the fourth side panel by score lines;

first, second, third and fourth inner side panels, the first and fourth of which overlie part of the central panel at a first one of the side edges adjacent the first side panel, and the second and third of which overlie part of the central panel at a second one of the side edges adjacent the third side panel;

opposed identical series of liner panels each connected to the first and third side panels along the second end thereof;

each of the first and third side panels including folding means for inverting the respective series of liner panels attached thereto by 180 degrees relative to the respective first and third side panel attached thereto; and wherein a first one of the series of liner panels includes, in sequence, a first partial liner panel partially overlying the second side panel, a first corner liner panel overlying the first corner panel, a first side liner panel overlying the first and fourth inner side panels, a fourth liner panel overlying the fourth corner panel, and a fourth partial side liner panel partially overlying the fourth side panel; and wherein a second one of the series of liner panels includes, in sequence, a third partial side liner panel partially overlying the fourth side panel, a third corner panel overlying the third corner panel, a third side liner panel overlying the second and third inner side panels, a second corner liner panel overlying the second corner panels, and a second partial side liner panel partially overlying the second side panel.

* * * * *